US005694660A

United States Patent [19]

Rachwalski

[11] Patent Number: 5,694,660

[45] Date of Patent: Dec. 9, 1997

[54] TOOL FOR CLEANING CLEATED SHOES

[76] Inventor: Joseph E. Rachwalski, 49 North End Ter., Bloomfield, N.J. 07003

[21] Appl. No.: 714,230

[22] Filed: Sep. 16, 1996

[51] Int. Cl.[6] ..... A63B 57/00

[52] U.S. Cl. ..... 15/237; 15/105; 15/236.08; 7/138; 7/169

[58] Field of Search ..... 7/138, 169; 15/105, 15/236.01, 236.08, 236.09, 237; 32/46, 47, 49

[56] References Cited

U.S. PATENT DOCUMENTS

| | | | |
|---|---|---|---|
| D. 320,492 | 10/1991 | Diebert | D32/46 |
| 1,267,265 | 5/1918 | Pignani | 7/138 |
| 2,461,639 | 2/1949 | Grigalunas | 7/169 |
| 2,817,863 | 12/1957 | Johns | 15/237 |
| 2,898,674 | 8/1959 | Anderson | 7/169 |
| 2,980,936 | 4/1961 | Snow | 15/237 |
| 3,045,270 | 7/1962 | Blumlo | 15/237 |
| 3,111,698 | 11/1963 | Reichle | 15/237 |
| 3,763,515 | 10/1973 | Voss | 15/236.08 |
| 5,226,647 | 7/1993 | Notarmuzi | 15/236.08 |
| 5,440,777 | 8/1995 | Olivieri | 15/236.08 |

*Primary Examiner*—Randall Chin

*Attorney, Agent, or Firm*—Mathews, Collins, Shepherd & Gould, P.A.

[57] ABSTRACT

In accordance with the present invention, a tool for cleaning shoe soles having cleats comprises a thin, elongated bar of material wherein at least one end comprises a generally V-shaped notch portion and, on at least one side of the notch portion, a scraping portion to facilitate the removal of mud. The notch portion is formed by converging surfaces having a relatively wide open end tapering to a relatively narrow closed end. In use, the notched portion is pushed into a cleat, which it contacts at two points, and rotated around the cleat, causing a scraping portion to clean around the cleat periphery. Advantageously the notch portion has a width greater than its depth to permit cleaning of a wide range of cleat diameters, and the notch walls are straight (rather than beveled) to provide solid pivot contacts. The scraping portion is advantageously beveled. In a preferred embodiment, at least one side of the bar is provided with a crenelated portion to facilitate removal of mud (particularly dried mud) from flat regions of the sole, and one or more smaller v-shaped notches for smaller cleats. One end of the bar can include one or more apertures which can be used for hanging the tool or as wrenches for removing and replacing cleats. The tool can be safely and conveniently made of molded plastic such as nylon.

9 Claims, 3 Drawing Sheets

TOOL FOR CLEANING CLEATED SHOES

CROSS REFERENCE TO RELATED APPLICATIONS

This application claims the benefit of U.S. Provisional application Ser. No. 60/011,100 entitled DEVICE FOR CLEANING CLEATED SHOES filed by the applicant on Feb. 5, 1996.

FIELD OF THE INVENTION

The present invention relates to a device for cleaning footwear and, in particular, to a tool particularly useful for cleaning shoes having cleats.

BACKGROUND OF THE INVENTION

Shoes having cleated soles are of great utility in a number of occupations and recreational activities. Such shoes provide safety to pole climbers, permit fast starts for track and field athletes, and provide secure footing for football and soccer players on wet grass.

A long-standing problem with such shoes is the difficulty of cleaning cleated soles. The cleated soles tend to pick up mud, particularly wet clay, which reduces traction and is particularly difficult to remove when dry. Because of the cleats, the usual solution of wiping the shoes on the grass or scraping them against a sharp surface simply does not work.

A wide variety of tools have been employed to scrape mud from cleated soles but none are completely satisfactory. The traditional tool is the nearest stick which rarely has adequate fit to provide a good cleaning. Metal tools, such as screwdrivers make their appearance at the sidelines of athletic fields, but most metal scraping tools are ill-adapted for cleat cleaning. While most cleats are circular in cross section, most scraping tools have linear scraping edges. Moreover metal scraping tools present serious safety concerns near athletic fields.

U.S. Pat. No. 5,509,167 entitled "Cleat Cleaning Tool" issued to Dylan Wilson on Apr. 23, 1996 describes a specialized cleat cleaning tool comprising a pair of adjacent prongs defining a groove with parallel sides and constant width. This device is designed primarily for planar cleats and is ill suited for the round cleats used in many field sports.

U.S. Pat. No. 4,670,932 entitled "Cleaner Tool For Cleated Shoes" issued to Jeffrey S. Williams on Jun. 9, 1987 also describes a specialized cleat cleaning tool. This tool also has a constant width groove chosen to fit a golf cleat (See FIG. 1). The end of the tool and the end of the groove are beveled so that when the groove encompasses a cleat, a linear thrust will scrape the area up to the cleat. The difficulty with this design is limited versatility. The device is designed to clean cleats of a given diameter and is ill suited for cleats of a different diameter, e.g. the groove for cleaning golf cleats would be too small to clean soccer cleats. Moreover some shoes have cleats of more than one size. Accordingly there remains a need for an improved cleat cleaning device.

SUMMARY OF THE INVENTION

In accordance with the present invention, a tool for cleaning shoe soles having cleats comprises a thin, elongated bar of material wherein at least one end comprises a generally V-shaped notch portion and, on at least one side of the notch portion, a scraping portion to facilitate the removal of mud. The notch portion is formed by converging surfaces having a relatively wide open end tapering to a relatively narrow closed end. In use, the notched portion is pushed into a cleat, which it contacts at two points, and rotated around the cleat, causing the scraping portion to clean around the cleat periphery. Advantageously the notch portion has a width greater than its depth to permit cleaning of a wide range of cleat diameters, and the notch walls are straight (rather than beveled) to provide solid pivot contacts. The scraping portion is advantageously beveled. In a preferred embodiment, at least one side of the bar is provided with a crenelated portion to facilitate removal of mud (particularly dried mud) from flat regions of the sole, and one or more smaller v-shaped notches for smaller cleats. One end of the bar can include one or more apertures which can be used for hanging the tool or as wrenches for removing and replacing cleats. The tool can be conveniently made of molded plastic such as nylon.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

DETAILED DESCRIPTION

Figure 1:
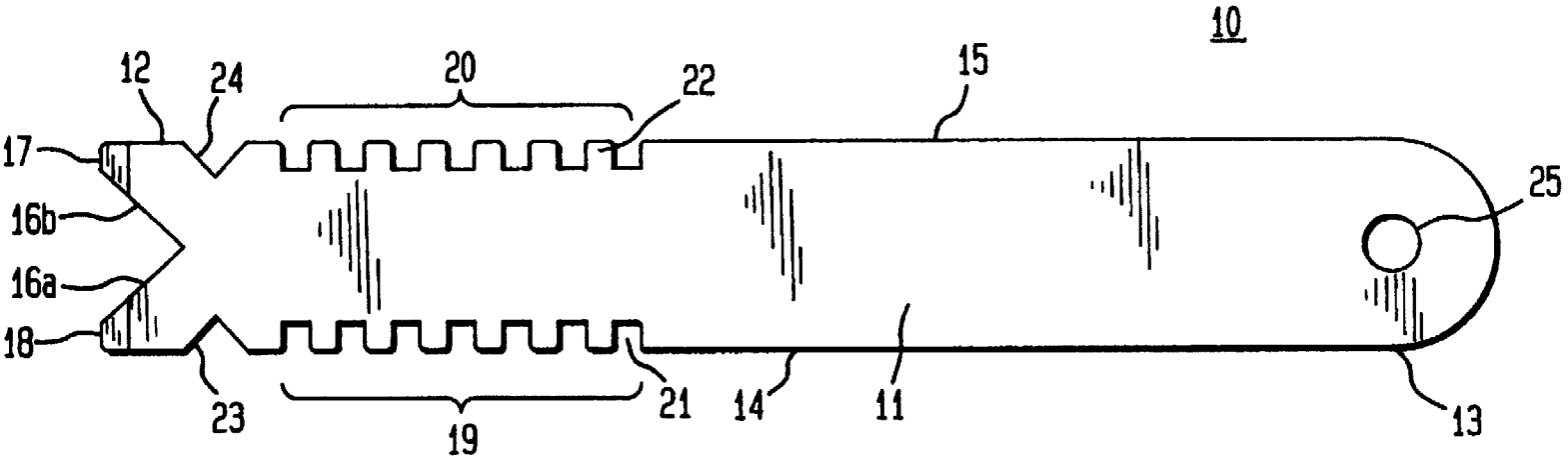
FIGS. 1 and 2 are top and side views of a preferred embodiment of a tool for cleaning shoe soles having cleats.

Referring to the drawings, FIG. 1 is a top view of a preferred embodiment of a cleaning tool 10 comprising a flat, thin, elongated bar of material 11 of a uniform thickness comprising a pair of ends 12, 13 and a pair of longer sides 14, 15. The bar is thin in that its thickness is less than one-fourth of its width and is elongated in that its length exceeds at least three times its width. At least one end, 12 comprises a generally V-shaped notch portion defined by converging side walls 16A and 16B. On at least one side of the notch is a scraping portion 17 to facilitate the removal of mud. The notch side walls 16A and 16B are preferably planar rather than beveled for reasons which will be described below. The notch advantageously has an opening width exceeding its depth and the relatively wide open end tapers to a relatively narrow closed end so that the device may clean a wide range of cleat diameters in the manner illustrated in FIG. 4. The wall of the scraping portion 17 is advantageously beveled. In this preferred embodiment there are two beveled scraping portions 17, 18 on either side of the notch. The beveled scraping portions 17, 18 have a reduced thickness in side view as shown in FIG. 2.

In this preferred embodiment at least one side and preferably both sides 14, 15 are provided with crenelated portions 19 and 20, respectively, for facilitating removal of mud (particularly dried mud) from a planar portion of the sole. Each crenelated portion is comprised of alternating sequence of recessed regions 21 and extended regions 22. Preferably the comers of the extended regions are rounded for safety.

In addition, in the preferred embodiment at least one and preferably both sides 14, 15 are provided with one or more additional, generally V-shaped notches 23, 24 respectively which are advantageously smaller than the end notch. It is contemplated that the end notch be used for larger cleats such as soccer or football cleats and that side notches 23, 24 be used for smaller diameter cleats such as golf and track cleats.

Figure 2:
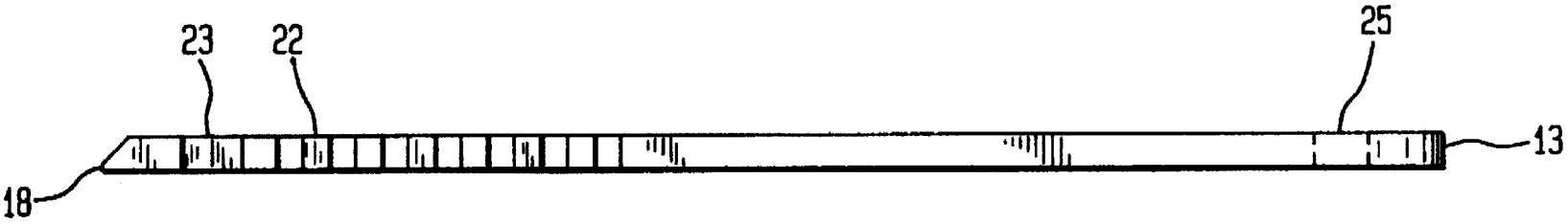

As can be seen from the side view of FIG. 2, the device is substantially planar and free of projections perpendicular to the surface shown in FIG. 1. The advantage of this planar configuration is that the cleaning device can easily be transported between sock and shinguard, affording instant availability for the removal of mud or debris on or off the field.

Figure 3A:
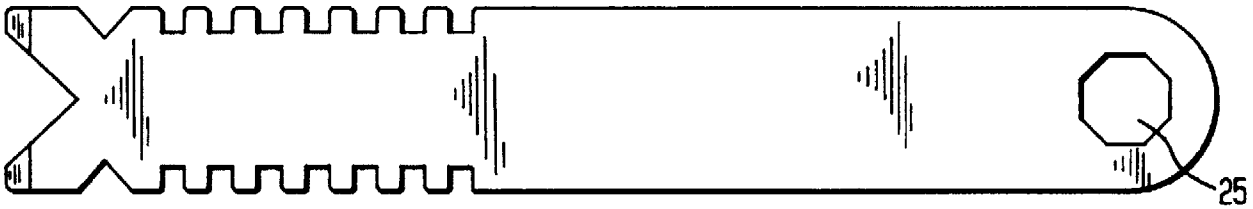
FIGS. 3A, 3B and 3C illustrate alternative apertures for the tool of FIG. 1.
Figure 3B:
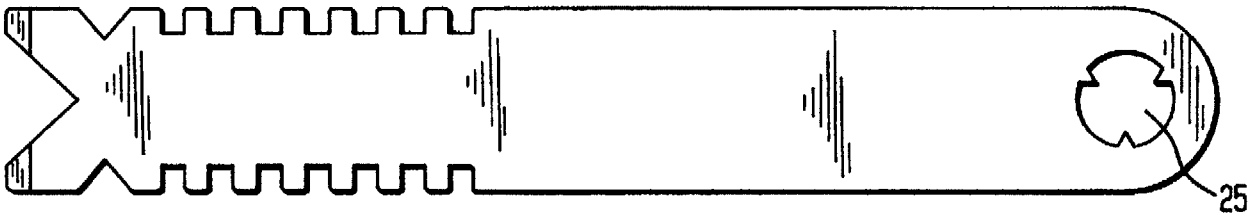
Figure 3C:
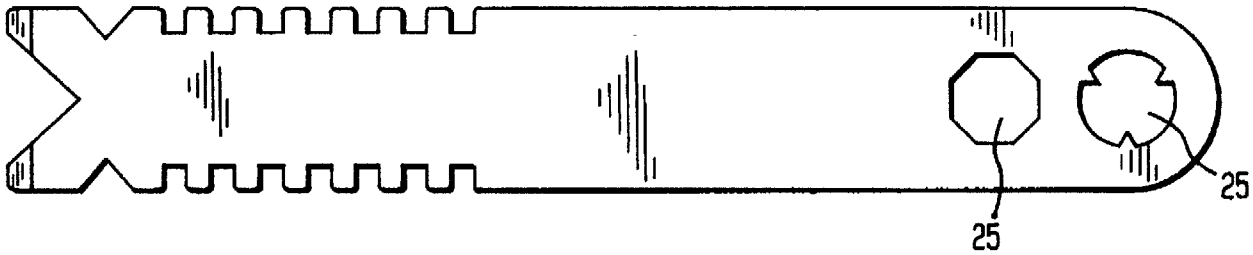

Advantageously the end 13 opposite end 12 is rounded for safety and contains one or more apertures 25. The apertures can be circular for hanging as shown in FIG. 1 or shaped to form cleat wrenches such as the hexagonal aperture of FIG. 3A, the soccer cleat shape of FIG. 3B or both together as shown in FIG. 3C.

The tool can be made of molded plastic. It is conveniently molded of nylon in a conventional injection molding process. The dimensions of the preferred embodiment are substantially as illustrated in FIGS. 1 and 2.

Figure 4:
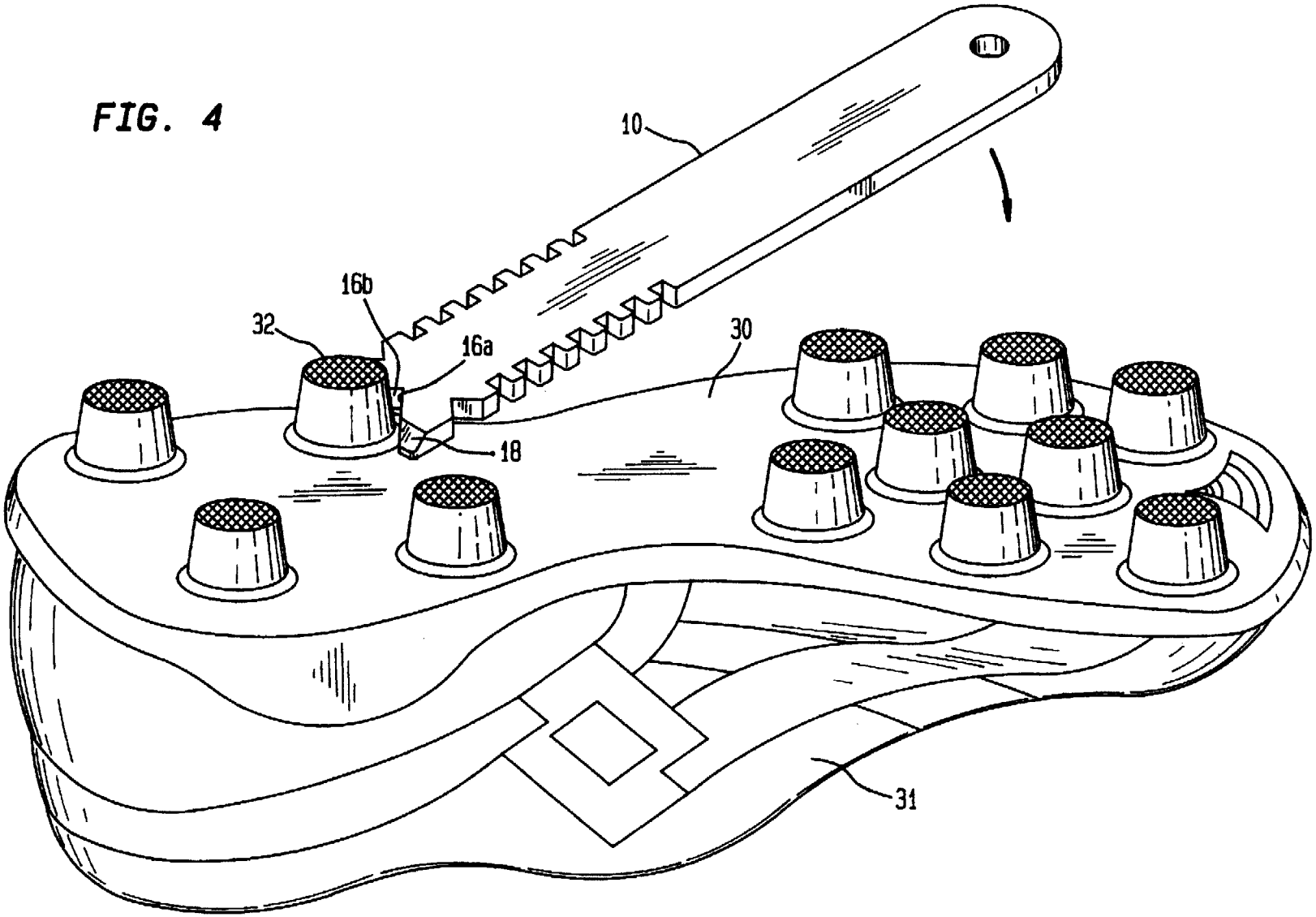
FIG. 4 illustrates the preferred way of using the tool of FIG. 1.

FIG. 4 illustrates the preferred way of using the tool of FIG. 1. Specifically, the tool 10 is moved across the sole 30 of a shoe 31 so that the end notch partially surrounds and contacts a cleat 32. Using a contact between the cleat and the notch wall 16B as a pivot, the tool is rotated around the cleat in such a fashion that a scraping portion (e.g. 18) scrapes the sole peripherally around the cleat. For this operation it is advantageous that the notch walls 16A, 16B be planar rather than beveled in order to provide a solid contact for pivoting the scraping surfaces. With scraping portions 17 and 18 on either side of notch 16, rotation can be in either direction, and bevels in the scraping portion further facilitate the removal of dirt and mud.

The advantages of this tool are manyfold. It is lightweight, easily stored and carried, safer and less expensive than metal tools, and provides superior peripheral cleaning around circular cleats. It is versatile in providing regions for a wide variety of cleat sizes, regions for both wet and dried mud, and an aperture for hanging or use as a cleat wrench.

It is to be understood that the above-described embodiments are illustrative of only a few of the many possible specific embodiments which can represent applications of the principles of the invention. For example, while the end notch is shown with intersecting planar walls, it is clear that the notch could also be made with converging curved walls. Thus numerous and varied other tools can be readily devised by those skilled in the art without departing from the spirit and scope of the invention.

What is claimed:

1. A tool for cleaning cleated footwear comprising:

a flat, thin, elongated bar of material of a uniform thickness having first and second ends and first and second sides, said sides longer than said ends;

at least one of said ends comprising a first V-shaped notch portion formed by intersecting planar side walls, said notch having a depth which is less than its width and said end further comprising on at least one side of said notch, a beveled scraping portion having a reduced thickness in side view to facilitate the removal of dirt wherein at least one side of said bar comprises a crenelated region comprising alternating recessed regions and extended regions.

2. The tool of claim 1 wherein said first end comprises said v-shaped notch and said second end is rounded.

3. The tool of claim 1 wherein said bar includes at least one aperture.

4. The tool of claim 3 wherein said at least one aperture is shaped to provide a cleat wrench.

5. The tool of claim 1 wherein said end comprising said notch comprises beveled scraping portions on either side of said notch.

6. The tool of claim 1 wherein said extended regions of said crenelated region are rounded.

7. The tool of claim 1 wherein said first and second sides each comprise a crenelated region having rounded extended regions.

8. The tool of claim 1 wherein at least one side of said bar comprises a second v-shaped notch, said second notch having a width less than said first notch.

9. The tool of claim 1 wherein said tool is substantially planar.

* * * * *